US006470684B2

(12) United States Patent
Wilbraham

(10) Patent No.: US 6,470,684 B2
(45) Date of Patent: Oct. 29, 2002

(54) GAS TURBINE ENGINE COMBUSTION SYSTEM

(75) Inventor: Nigel Wilbraham, Glen Parva (GB)

(73) Assignee: Alstom Power N.V., Amsterdam (NL)

( * ) Notice: Subject to any disclaimer, the term of this patent is extended or adjusted under 35 U.S.C. 154(b) by 0 days.

(21) Appl. No.: 09/823,279

(22) Filed: Mar. 30, 2001

(65) Prior Publication Data

US 2001/0045094 A1 Nov. 29, 2001

(30) Foreign Application Priority Data

Apr. 1, 2000 (GB) ..... 0007970
Apr. 1, 2000 (GB) ..... 0007971

(51) Int. Cl.[7] ..... F02C 7/22
(52) U.S. Cl. ..... 60/737; 60/746; 60/748; 239/690
(58) Field of Search ..... 60/737, 740, 746, 60/748; 239/708, 690

(56) References Cited

U.S. PATENT DOCUMENTS 3,358,731 A * 12/1967 Donnelly ..... 431/262
3,749,545 A 7/1973 Velkoff
4,439,980 A 4/1984 Biblarz et al.
4,508,265 A * 4/1985 Jido ..... 239/708
4,892,139 A * 1/1990 LaHaye et al. ..... 110/216
5,450,724 A * 9/1995 Kesseli et al. ..... 60/737
5,515,681 A * 5/1996 DeFreitas ..... 60/740
5,590,517 A 1/1997 DeFreitas
5,628,180 A * 5/1997 DeFreitas ..... 60/740
5,845,480 A * 12/1998 DeFreitas et al. ..... 60/776
6,151,899 A * 11/2000 Park ..... 60/746

* cited by examiner

*Primary Examiner*—Michael Koczo
(74) *Attorney, Agent, or Firm*—Kirschstein, et al.

(57) ABSTRACT

A gas turbine engine includes a combustion main chamber into which opens one end of an upstream combustion pre-chamber having a burner face at its opposite end. A swirler assembly has a plurality of generally tangentially extending swirler vanes circumferentially spaced by passages disposed about a center and along which combustion air follows radially inward paths into the pre-chamber. Each passage is provided with a respective liquid fuel injection nozzle including an electrode to be electrostatically charged so each injection nozzle can impart electrostatic charge to droplets of fuel emerging from the nozzles to travel with the combustion air into the pre-chamber. Walls of the passages comprise electrodes which can be charged to the same polarity as the charged fuel. The burner face is preferably formed of two or three electrodes, one being a central electrode at opposite polarity to the charge on the fuel and at least one other electrode surrounding the central electrode and at the same polarity as the charge on the fuel. The pre-chamber has a wall also forming an electrode which may be charged at the same polarity as the charge on the fuel droplets. The disposition of the electrostatic charge in the apparatus promotes fuel atomizing and keeps the fuel off the walls of the passage and off the burner face while attracting or biasing the fuel towards the center of the burner face and pushes the fuel toward the center of the pre-chamber.

21 Claims, 2 Drawing Sheets

GAS TURBINE ENGINE COMBUSTION SYSTEM

BACKGROUND OF THE INVENTION

1. Field of the Invention

This invention concerns a gas turbine engine combustion systems and also concerns gas turbine engines provided with such systems.

2. Detailed Description of the Related Art

It is known to improve atomization and placement or positioning of liquid fuels within gas turbine engine combustion chambers by the use of electrodes located so as to impart electrostatic charge to the fuel droplets. For example, U.S. Pat. No. 4,439,980 discloses a gas turbine engine wherein fuel is injected through a spray injection nozzle towards an electrode in a combustion chamber so that after it has left the injection nozzle, the fuel becomes electrostatically charged, and the strength of the electric field is adjusted to provide a spray characteristic said to produce an optimum engine performance.

The inventor believes that further increased control of fuel placement, vaporization and combustion intensity is desirable. This would lead to greater combustion stability, particularly at low fuel injection rates, and lower emission of pollutants from engines. In particular, it is desirable to still further improve the already good low emissions and stability characteristics of gas turbine engine combustors of the lean burn type employing combustion "pre-chambers", which are of smaller volume and cross-sectional area than a main combustion chamber into which they discharge. These pre-chambers receive preswirled, premixed liquid fuel/air mixtures for combustion therein from "preswirlers", the latter comprising for example circular arrays of vanes defining passages therebetween which are configured to impart to the fuel/air mixture a swirling motion about a longitudinal axis of the pre-chamber. In one known efficient class of preswirler with which the inventor is particularly concerned, the fuel/air mixture enters a cylindrical pre-chamber from preswirler passages at the pre-chamber's upstream end, the preswirler passages being oriented such that the fuel/air mixture enters the pre-chamber with a mainly tangential component of velocity, though a radial velocity component is also present for a desired amount of penetration of the mixture towards the pre-chamber combustion region.

SUMMARY OF THE INVENTION

An object of the invention is therefore to provide a gas turbine engine combustion system in which one or more of fuel placement, vaporization and combustion intensity may be more accurately controlled to produce an improved combustion performance.

According to the invention, a gas turbine engine combustion system comprises a combustion main chamber, a combustion pre-chamber upstream thereof and opening into the main chamber, the pre-chamber being of smaller flow area than the main chamber and being disposed about a longitudinal axis, a burner face at an upstream end of the pre-chamber, a preswirler assembly comprising a plurality of preswirl passages communicating with the upstream end of the pre-chamber for supplying a preswirled air/fuel mixture to the pre-chamber, the preswirl passages being disposed about the longitudinal axis, atomizing injection nozzles located in the preswirl passages to inject atomized fuel thereinto, each said injection nozzle including a first electrode means operable to selectively electrostatically charge the first electrode means at a pre-determined polarity thereby to impart electrostatic charge to the atomized fuel, second electrode means forming at least portions of the preswirl passages, and means operable to selectively electrostatically charge the second electrode means at the same polarity as the first electrode means, thereby to repel the atomized injected fuel from the preswirl passage portions.

The pre-chamber is preferably of cylindrical form, with the preswirl passages extending substantially tangentially to the periphery of the pre-chamber.

Each preswirl passage may have at least one atomizing injection nozzle located therein and each first electrode means preferably comprises a sharp charge-emitting edge disposed around an exit of its corresponding atomizing injection nozzle.

Preferably the second electrode means comprises walls of the preswirl passages and, in fact, it is convenient if the preswirler assembly itself comprises the second electrode means.

Third electrode means may be provided in association with the burner face, and means may be provided for holding the third electrode means at a potential with respect to the electrostatically charged fuel such that the fuel is biased towards the third electrode means. At least a portion of the burner face, preferably a substantially central portion, may comprise the third electrode means.

A preferred embodiment provides fourth electrode means extending peripherally of the third electrode means, and means to selectively electrostatically charge the fourth electrode means at the same polarity as the charged fuel. The first and fourth electrode means may be connected in an electrically conducting manner whereby said first and fourth electrode means are at the same potential. Furthermore, a fifth electrode means may be interposed between the third and fourth electrode means, means being operable to selectively electrostatically charge the fifth electrode means at a polarity opposite that of the charge on the fuel. Advantageously, a fuel ignition means is disposed in the fourth or fifth electrode means.

The combustion system may be further provided with sixth electrode means comprising at least a portion of the pre-chamber, and means to selectively electrostatically charge the sixth electrode means at the same polarity as the charge on the fuel. Preferably, a wall region of the pre-chamber comprises the sixth electrode means.

In a gas turbine engine comprising an aforesaid combustion system according to the invention, repulsion of the fuel by the second electrode means tends to keep the fuel off walls of the swirler assembly. Where the sixth electrode means is provided in the pre-chamber, repulsion of fuel thereby tends to focus fuel flow closer to the axis of the pre-chamber and away from the wall of the pre-chamber. Such control of fuel flow admits improvements in engine operation particularly at ignition or at low load, for example load shedding operation, and because the fuel is in atomized liquid or droplet form, keeping it off the swirler assembly or the pre-chamber wall tends to avoid coking the assembly or the pre-chamber. If ignition means is provided in the burner face, fuel attracted thereacross towards the burner face has an improved chance of ignition and this can also improve operation of the gas turbine engine.

Further aspects of the invention will be apparent from the following description and claims.

BRIEF DESCRIPTION OF THE DRAWINGS

Embodiments of the invention will now be further described, by way of example only, with reference to the accompanying drawings in which.

DETAILED DESCRIPTION OF THE PREFERRED EMBODIMENTS

Figure 1:
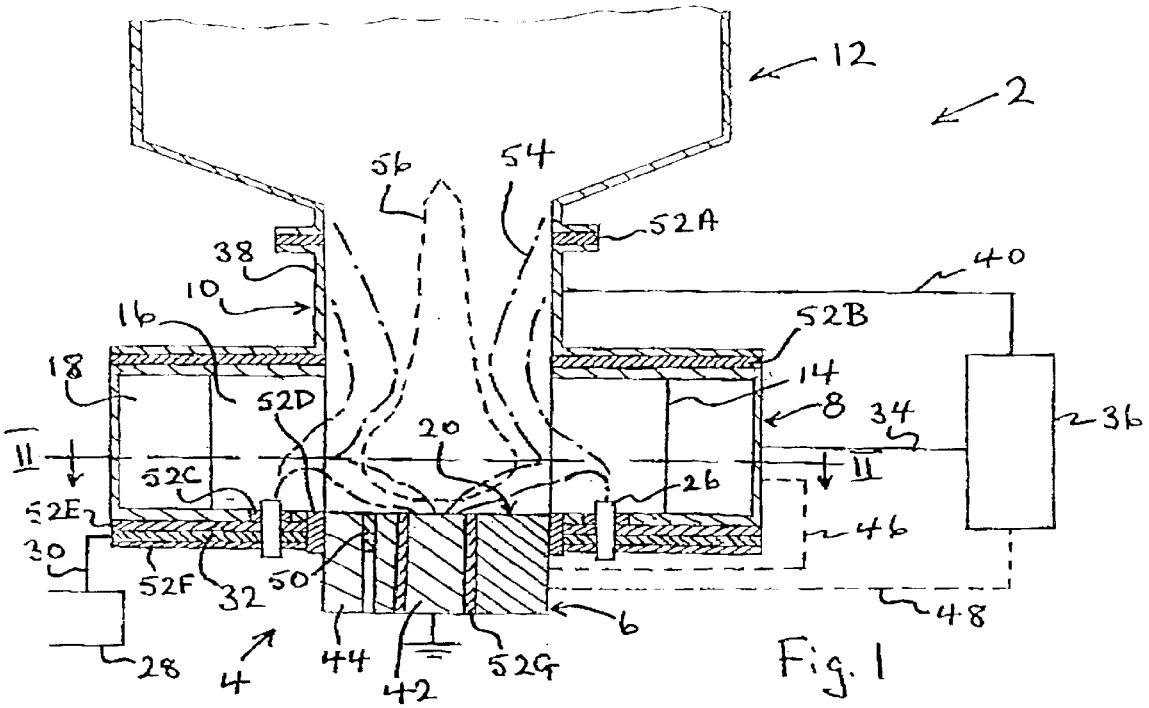
FIG. 1 is a diagrammatic and fragmentary longitudinal section of an embodiment of a gas turbine combustion system formed according to the invention shown operating in a pre-determined mode.

In the drawings like references identify like or comparable parts.

Figure 2:
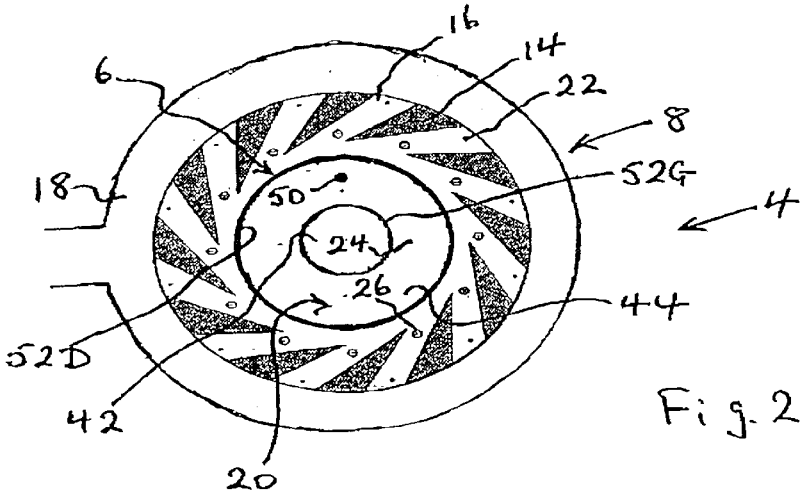
FIG. 2 is a representation of a section on line II—II in FIG. 1 including certain further information.

With reference to FIGS. 1 and 2 a gas turbine engine (not shown) comprises a plurality of combustors, such a combustor being indicated at 2. The combustor 2 comprises a burner 4 having a burner head 6, a radial-inflow swirler assembly 8, a cylindrical pre-chamber 10, and a larger diameter main combustion chamber 12 downstream of the pre-chamber.

The swirler assembly 8 comprises a plurality of swirler vanes 14 disposed about a central axis and separating passages 16 along which compressed combustion air flows generally inwardly from an encircling manifold 18 supplied with compressed air by the compressor of the gas turbine engine. As shown particularly in FIG. 2, passages 16 are oriented substantially tangentially to the periphery of the pre-chamber 10. On leaving the passages 16 the combustion air enters the pre-chamber 10 adjacent to its upstream end with large tangential and smaller radial components of velocity. A burner face 20 of the burner head 6 is disposed at the upstream end of the pre-chamber 10.

The combustor 2 can burn fuel gas, for example, natural gas, or atomized liquid fuel. When operating with fuel gas, pilot fuel gas can be supplied to the pre-chamber 10 by a pilot gas system (not shown) whereas the main fuel gas supply is through gas jets or nozzles 22 (shown only in FIG. 2) opening into the swirler passages 16 adjacent to the radially outer ends of the passages. When operating in liquid fuel mode pilot liquid fuel is supplied from liquid fuel pilot jets or nozzles 26 at the burner face 20, and main liquid fuel is supplied in atomized droplets form from main liquid fuel injection jets or nozzles 26 opening into the swirler passages 16 adjacent to the radially inner or outlet ends of the swirler passages.

Figure 5:
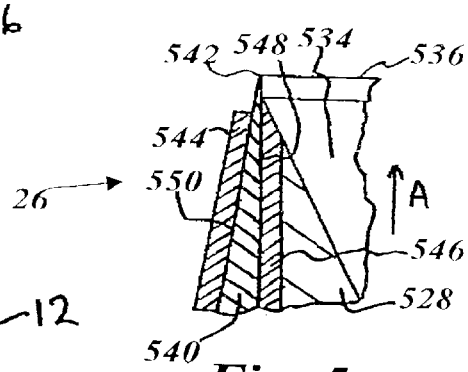
FIG. 5 is a sectional view through part of an atomizing fuel injection nozzle suitable for use with the invention.

Each injection nozzle 26 is connected to a supply of liquid fuel (not shown) and the nozzle is arranged in known manner to atomize or reduce to droplets the fuel emitted thereby into the swirler assembly 8 to mix with the combustion air entering the pre-chamber 10, suitable means being provided at, on or within each nozzle to spray electrostatic charge onto the fuel droplets. The inventor's co-pending U.S. patent application of even date herewith, (Ser. No. 09/823,930; Pub. No. U.S. 2001/0045474A1) the entire contents of which are incorporated herein by reference thereto, and claiming priority from patent application No. GB0007971.5 discloses such an injection nozzle 26 and the reader is referred thereto for further details not included in the present specification. However, FIG. 5 of the present specification is reproduced from the above-mentioned copending U.S. application and illustrates that each nozzle 26 can comprise an electrode suitably shaped to efficiently impart electrostatic charge to the fuel. In this case, an electrode 540 has a sharp edge 542 disposed around the circular outlet end 536 of a divergent nozzle passage 534, whereby electrostatic charge is emitted by the sharp edge of the electrode to impart electrostatic charge to the emitted fuel A. Advantageously, the charge is imparted to the fuel by the electrode just at the point when the stream of fuel which adheres to the interior wall of the nozzle passage 534 starts to break up into droplets as it leaves the nozzle outlet end 536. Except at its sharp tip 542, which projects beyond the nozzle's main body 528, the electrode 540 is insulated from the environment and the nozzle's main body 528 by layers of insulation 544 and 546 respectively. Such insulation may be mica or a ceramic, for example. An inner surface 548 of the electrode is cylindrical to match the shape of the outer surface of the nozzle body 528, while an outer surface 550 of the electrode is frusto-conical so as to define the included angle of the sharp edge 542.

To provide electrostatic charge to the electrodes, a charge supply and control unit 28 (as known per se) is connected by line 30 to an annular conductor 32 supplying the electrodes 540 of the nozzles 26. Preferably, the electrodes, and hence the fuel droplets exiting the nozzles 26, are positively charged.

The swirler assembly 8, or at least wall portions of the swirler passages 16, for example surfaces of the vanes 14, comprise an electrode charged electrostatically via line 34 by another charge supply and control unit 36. When charged, the electrode 8 is charged at the same polarity as the fuel droplets.

Pre-chamber 10 has a chamber wall 38 which also comprises an electrode charged electrostatically via line 40 by the supply and control unit 36. When charged, electrode 38 is charged at the same polarity as the fuel droplets.

The burner head 6 comprises two electrodes 42 and 44 exhibiting electrode faces at the burner face 20. Electrode 42 is a central electrode represented as a cylinder in the drawings and electrode 44 is a surrounding electrode represented as a ring. The electrode 44 is charged electrostatically at the same polarity as the fuel droplets. This may be achieved by connecting the electrode 44 conductively to the electrode 8 by a conductive connection 46 so that the electrodes 8 and 44 are at the same potential. Alternatively, there may be no connection 46 and instead a line 48 may be provided so that electrode 44 may be charged by the supply and control 36 via the line 48, in which case the electrode 44 may be at a different potential to that of the electrode 8.

Preferably central electrode 42 is to be charged oppositely to the fuel, or at least to a lower potential. This may be achieved by connecting the central electrode 42 to a suitable electrostatic charge supply and control unit, or may be achieved, when the fuel charge is positive, by grounding central electrode 42 so as to be at a lower potential than the electrodes of the nozzles 26 and the other electrodes 8, 38 and 44.

An igniter for the fuel is represented at 50 embedded in the face of the electrode 44 and may be adjacent to a periphery of the central electrode 42.

Insulation, for example mica or a ceramic, to maintain electrodes isolated from one another or other parts of the system is indicated at 52A, 52B, 52C, 52D, 52E, 52F and 52G.

The fuel emitted by nozzle 26 may be selectively electrostatically charged or not charged by the units 52, 60, as desired, depending on the desired nature of operation of the gas turbine engine. In particular, during operation of the engine at low loads, when lower volumes of liquid fuel are being delivered to the injector nozzles 26, the additional control of fuel atomization, vaporization, placement and combustion intensity obtainable by electrostatic charging of the electrodes is advantageous. Also as desired the electrodes 8, 38, 42 and 44 may be charged simultaneously or only one or any combination thereof charged or held at any appropriate desired potential. Under full load operation of the engine, when larger volumes of liquid fuel are being delivered to the injector nozzles 26, good fuel atomization, vaporization, placement and combustion intensity may be achievable if none of the electrodes are charged.

The control units 28 and 36 may operate independently and control unit 36 may charge the respective electrodes to which it is connected to different respective extents or potentials. The source of static electricity may be a battery, or be derived from an auxiliary electrical generator driven by the gas turbine engine.

With particular reference to FIG. 1, when the engine is performing under ignition operation mode with the liquid fuel from nozzles 26 positively charged and central electrode 42 grounded, (i) electrodes 8 and 44 may be positively charged and may be at the same potential, for example via connection 46, and (ii) electrode 38 may also be positively charged, for example slightly charged and thus be at a lesser potential with respect to the electrodes 8, 44. An example of an electrostatic field within the combustion system is indicated by dot-dash lines 54 and a resulting fuel placement position or envelope demarcating the position of the fuel flow is indicated by interrupted line 56. The charged droplets tend to be repelled from the swirler assembly 8 and from the wall 38 so the chance of that wall or those in assembly 8 becoming coked due to burning of fuel on their surfaces is reduced. Also, since the fuel is biased towards the central electrode 42, either by being attracted towards it, or at least by being less repelled by it than by the other electrodes, the chance of it being more effectively ignited by the igniter 50 as fuel moves thereover is improved. Fuel is not only electrostatically repelled by the swirler vanes 14 but also by the electrode 44. By reason of the electrostatic conditions described at ignition operation, liquid fuel vaporization rate is increased by (1) better fuel atomization (Coulomb Fission), by (2) Coulomb force which is much greater than usual aerodynamic force so the fuel droplets can move against air flows, and by (3) Coulomb force preventing droplets coalescing.

Figure 3:
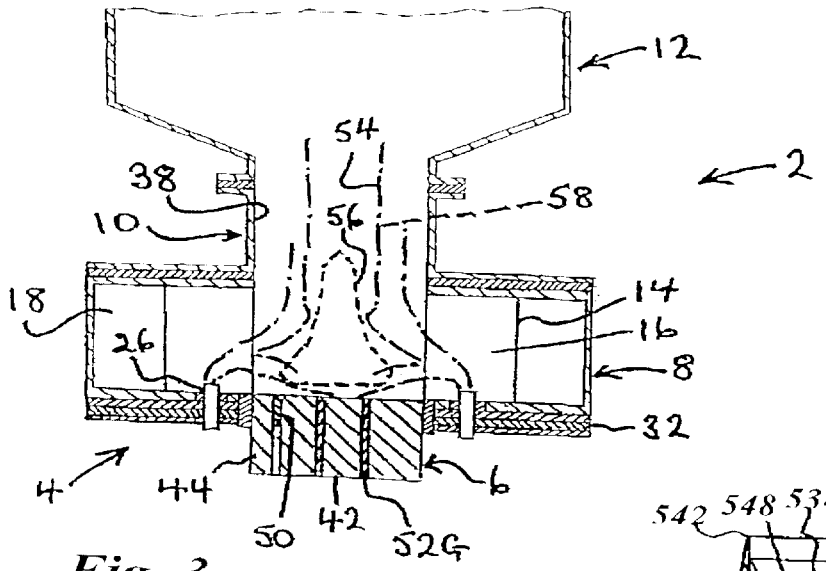
FIG. 3 is a diagrammatic longitudinal section comparable to FIG. 1 and wherein the gas turbine combustion system is shown operating in another pre-determined mode.

In FIG. 3, the engine is performing under load shed operation. The positive charge imparted to the fuel may preferably be a maximum that the system can provide. Central burner electrode 42 is grounded and (i) electrodes 8 and 44 may be positively charged, and may be at the same potential, and (ii) electrode 38 may also be positively charged, but to a higher potential than for ignition operation. Consequently, the electrostatic field is pinched at 58, so again biasing the fuel/air mixture towards the electrode 42. Electrodes 8, 38 and 44 may be at the same or different potentials. The effect of the electrostatic field on the fuel is to improve or increase its atomization, which is desirable when fuel flow rate is reduced. Also, high charge on electrodes 44 and 38 in combination with the grounded electrode 42 pulls and pushes the fuel upstream towards the center of the burner head 6 at the upstream end of the pre-chamber 10, resulting in improved fuel concentration and therefore improved flame stability.

The use of electrostatic control of fuel placement can assist in:

(a) Controlling NOx emissions.

(b) Improving flame stability at ignition and load shed operation modes.

(c) Reducing the need for the use of more than one set of fuel nozzles to inject liquid fuel.

(d) Dampening rumble in combustion systems, due to the reduction or elimination of unsteady combustion.

(e) Enhancing fuel vaporization rates and thereby reducing NOx.

(f) Enabling liquid fuel staging to be used in "can" type combustion systems. Liquid fuel staging is the technique of using the same injector nozzle or set of nozzles to inject fuel at low flow rates for low load operation and also at higher flow rates for operation of the engine at higher loads. Hitherto, this has been very difficult to achieve because conventional injector nozzles must be designed to exhibit optimum atomization over a restricted range of flow rates. The present invention tackles this problem by enabling better control of atomization and placement of the fuel within the combustor.

(g) Enabling use of a use of higher flow number liquid fuel injector nozzles while reducing the risk of coking of surfaces in the preswirler and the pre-chamber. Here, "flow number" is the UK flow number and is defined as the fuel flow rate through the nozzle in imperial gallons per hour divided by the square root of the pressure drop through the injector in pounds force per square inch. Conventionally, if high flow number nozzles are used, which give good fuel atomization at high fuel flow rates, they cannot adequately atomize the fuel at low fuel flow rates, and this leads to larger fuel droplets which are more liable to impinge and burn on combustor surfaces, thereby leading to coking of the surfaces. However, the use as described above of charged electrodes both in the injector nozzles and in the combustor components reduces or eliminates this problem.

(h) Enabling use of a wider range of liquid fuel types, due again to better atomization and control of fuel placement.

(i) Improving fuel and air mixing which results in reducing unburnt hydrocarbon emissions in the form of white smoke.

Figure 4:
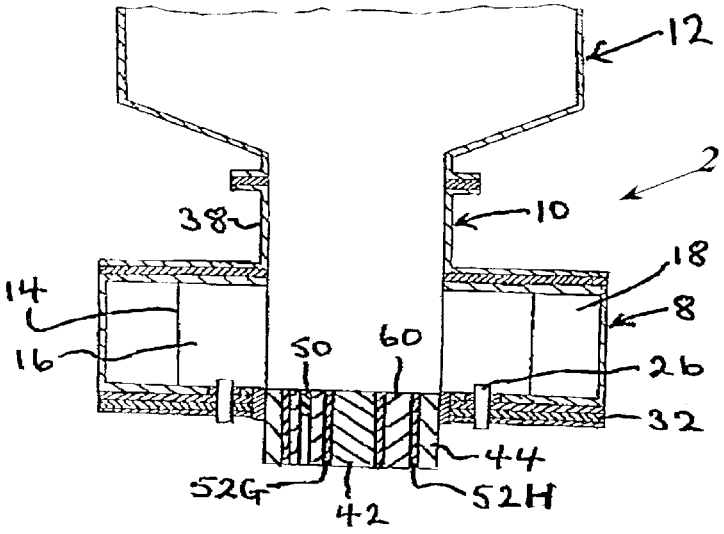
FIG. 4 is a section comparable to FIG. 1 of another embodiment of the gas turbine combustion system formed according to the invention.

In FIG. 4 another ring shaped electrode 60 is provided, interposed between the central electrode 42 and the outer ring electrode 44, from which electrode 60 is separated by insulation 52H.

In this case the igniter 50 is within a face of the electrode 60. In operation the electrode 60 can be electrostatically charged to an opposite polarity to that of the fuel droplets which are thus attracted towards the igniter 50 to improve fuel combustion and thus ignition mode operation of the engine.

The electrode 42 may be grounded as above, or taken to a lower potential than the nozzle 26.

Regarding the electrical potentials to be used in the present invention, the inventor presently estimates that potential differences of the order of several thousand volts are likely to be necessary to obtain the benefits of the invention.

I claim:

1. A gas turbine engine combustion system, comprising:

a) a combustion main chamber;

b) a combustion pre-chamber upstream and opening into the main chamber, the pre-chamber being of smaller flow area than the main chamber and being disposed about a longitudinal axis;

c) a burner face at an upstream end of the pre-chamber;

d) a preswirler assembly comprising a plurality of pre-swirl passages communicating with the upstream end of the pre-chamber for supplying a preswirled air/fuel mixture to the pre-chamber, the preswirl passages being disposed about the longitudinal axis;

e) atomizing injection nozzles located in the preswirl passages to inject atomized liquid fuel thereinto, each said injection nozzle including a first electrode means operable to selectively electrostatically charge the first electrode means at a pre-determined polarity thereby to impart electrostatic charge to the atomized fuel;

f) second electrode means forming at least portions of the preswirl passages; and g) means operable to selectively electrostatically charge the second electrode means at the same polarity as the first electrode means, thereby to repel the atomized injected fuel from the preswirl passage portions.

2. The combustion system according to claim 1, in which the pre-chamber is of cylindrical form.

3. The combustion system according to claim 2, in which the preswirl passages extend substantially tangentially to a periphery of the pre-chamber.

4. The combustion system according to claim 1, in which each preswirl passage has at least one atomizing injection nozzle located therein.

5. The combustion system according to claim 4, in which each first electrode means comprises a sharp charge-emitting edge disposed around an exit of its corresponding atomizing injection nozzle.

6. The combustion system according to claim 1, in which the second electrode means comprises walls of the preswirl passages.

7. The combustion system according to claim 1, in which the preswirler assembly comprises the second electrode means.

8. The combustion system according to claim 1, and further comprising third electrode means associated with the burner face, and means for holding the third electrode means at a potential with respect to the electrostatically charged fuel such that the fuel is biased towards the third electrode means.

9. The combustion system according to claim 8, in which at least a portion of the burner face comprises the third electrode means.

10. The combustion system according to claim 8, in which the third electrode means comprises a substantially central portion of the burner face.

11. The combustion system according to claim 8, and further comprising fourth electrode means extending peripherally of the third electrode means, and means for selectively electrostatically charging the fourth electrode means at the same polarity as the charged fuel.

12. The combustion system according to claim 11, in which the first and fourth electrode means are connected in an electrically conducting manner whereby said first and fourth electrode means are at the same potential.

13. The combustion system according to claim 11, in which fuel ignition means is disposed in the fourth electrode means.

14. The, combustion system according to claim 11, and further comprising fifth electrode means interposed between the third and fourth electrode means, and means operable for selectively electrostatically charging the fifth electrode means at a polarity opposite that of the charge on the fuel.

15. The combustion system according to claim 14, in which fuel ignition means is disposed in the fifth electrode means.

16. The combustion system according to claim 14, and further comprising sixth electrode means comprising at least a portion of the pre-chamber, and means for selectively electrostatically charging the sixth electrode means at the same polarity as the charge on the fuel.

17. The combustion system according to claim 16, in which a wall region of the pre-chamber comprises the sixth electrode means.

18. A gas turbine engine, comprising a combustion system including:

a) a combustion main chamber;

b) a combustion pre-chamber upstream and opening into the main chamber, the pre-chamber being of smaller flow area than the main chamber and being disposed about a longitudinal axis;

c) a burner face at an upstream end of the pre-chamber;

d) a preswirler assembly comprising a plurality of pre-swirl passages communicating with the upstream end of the pre-chamber for supplying a preswirled air/fuel mixture to the pre-chamber, the preswirl passages being disposed about the longitudinal axis;

e) atomizing injection nozzles located in the preswirl passages to inject atomized liquid fuel thereinto, each said injection nozzle including a first electrode means operable to selectively electrostatically charge the first electrode means at a pre-determined polarity thereby to impart electrostatic charge to the atomized fuel;

f) second electrode means forming at least portions of the preswirl passages; and g) means operable to selectively electrostatically charge the second electrode means at the same polarity as the first electrode means, thereby to repel the atomized injected fuel from the preswirl passage portions.

19. The gas turbine engine according to claim 18, and further comprising means by which the fuel is electrostatically positively charged.

20. The gas turbine engine according to claim 18, and further comprising third electrode means associated with the burner face, and in which the third electrode means is connectable to means held at ground potential.

21. The gas turbine engine according to claim 20, and further comprising fourth electrode means extending peripherally of the third electrode means, fifth electrode means interposed between the third and fourth electrode means, sixth electrode means comprising at least a portion of the pre-chamber, and means by which, when the engine is running under an ignition operation, the sixth electrode means is controlled to be less electrostatically charged than when the engine is running under a load shed operation.

* * * * *